US008142334B2

(12) United States Patent
Kim et al.

(10) Patent No.: US 8,142,334 B2
(45) Date of Patent: Mar. 27, 2012

(54) EARLY REHABILITATION TRAINING SYSTEM

(75) Inventors: Nam Gyun Kim, Jeollabuk-do (KR); Mun Ho Ryu, Jeollabuk-do (KR); Tae Kyu Kwon, Jeollabuk-do (KR)

(73) Assignee: Industrial Cooperation Foundation Chonbuk National University, Jeollabuk-Do (KR)

( * ) Notice: Subject to any disclaimer, the term of this patent is extended or adjusted under 35 U.S.C. 154(b) by 215 days.

(21) Appl. No.: 12/522,150

(22) PCT Filed: Dec. 28, 2007

(86) PCT No.: PCT/KR2007/006924

§ 371 (c)(1),
(2), (4) Date: Jul. 2, 2009

(87) PCT Pub. No.: WO2008/082172

PCT Pub. Date: Jul. 10, 2008

(65) Prior Publication Data

US 2010/0042022 A1 Feb. 18, 2010

(30) Foreign Application Priority Data

Jan. 3, 2007 (KR) ..... 10-2007-0000658

(51) Int. Cl.
*A63B 22/06* (2006.01)
*A61H 1/02* (2006.01)

(52) U.S. Cl. ..... 482/57; 482/142; 601/23; 601/24

(58) Field of Classification Search ..... 482/51, 482/57–65, 142, 92, 148; 297/15; 601/23, 601/24, 26

See application file for complete search history.

(56) References Cited

U.S. PATENT DOCUMENTS

| | | | | | |
|---|---|---|---|---|---|
| 3,744,480 | A * | 7/1973 | Gause et al. | 600/520 |
| 3,750,479 | A * | 8/1973 | Gause et al. | 73/379.07 |
| 3,910,571 | A * | 10/1975 | Stenn | 482/60 |
| 4,601,464 | A * | 7/1986 | Mousel | 482/60 |
| 4,842,265 | A * | 6/1989 | Kirk | 601/31 |
| 4,973,046 | A * | 11/1990 | Maxwell | 482/60 |
| 4,976,426 | A | 12/1990 | Szabo et al. | |
| 5,308,302 | A * | 5/1994 | Miller | 482/60 |
| 5,421,798 | A * | 6/1995 | Bond et al. | 601/23 |
| 6,893,386 | B2 * | 5/2005 | Charoenchit | 482/142 |
| 7,399,259 | B2 * | 7/2008 | Somwong | 482/57 |
| 7,418,862 | B2 * | 9/2008 | Gruben et al. | 73/379.07 |

(Continued)

FOREIGN PATENT DOCUMENTS

JP 2003-062020 3/2003

(Continued)

*Primary Examiner* — Stephen Crow
(74) *Attorney, Agent, or Firm* — Rabin & Berdo, P.C.

(57) ABSTRACT

Provided is an early rehabilitation training system that increase the intensity of patient rehabilitation training to shorten the time it takes for patients to progress to a secondary rehabilitation training stage by allowing patients incapable of self-ambulation to be artificially rehabilitated in a prone, bed-ridden position. The system includes a treatment bed (2) configured with a mattress (2*a*), a base (2*b*) disposed below the mattress (2*a*) and coupled through a hinge to one end of the mattress (2*a*), and a tilting unit (2*c*) provided between the mattress (2*a*) and the base (2*b*) to adjust an upright angle of the mattress (2*a*); and a rotating unit (10) provided below the mattress (2*a*) of the treatment bed (2) to secure a patient's feet and provide artificial exercising of the patient's feet through gravity when the upright angle of the mattress (2*a*) is changed by the tilting unit (2*c*).

2 Claims, 6 Drawing Sheets

1

U.S. PATENT DOCUMENTS 7,422,549 B2 * 9/2008 Matthews ..... 482/62
7,480,951 B2 * 1/2009 Weismiller et al. ..... 5/600
7,587,770 B1 * 9/2009 Reser et al. ..... 5/613
7,599,806 B2 * 10/2009 Hauschildt ..... 702/44
7,648,446 B2 * 1/2010 Chiles et al. ..... 482/57
7,806,810 B2 * 10/2010 Hanaya et al. ..... 482/61
7,833,135 B2 * 11/2010 Radow et al. ..... 482/57
7,837,595 B2 * 11/2010 Rice ..... 482/4
7,862,476 B2 * 1/2011 Blau et al. ..... 482/8

FOREIGN PATENT DOCUMENTS

KR 2006-0001819 1/2006

* cited by examiner

EARLY REHABILITATION TRAINING SYSTEM

BACKGROUND OF THE INVENTION

1. Field of the Invention

The present invention relates to an early rehabilitation training system, and more particularly, to an early rehabilitation training system that allows patients incapable of self-ambulation to be artificially rehabilitated in a prone, bed-ridden position, to increase the intensity of patient rehabilitation training and shorten the time it takes for patients to progress to a secondary rehabilitation training stage.

2. Description of the Related Art

In general, when hemiplegia occurs in conjunction with central nervous system injury, traumatic brain injury, etc., atrophied muscles are unable to exert force when needed and generate the amount of force required. Also, patients' endeavors to use muscles in both legs to maintain balance are reduced.

When prolonged, the inability to intended move or the natural unwillingness of hemiplegic patients to use atrophied muscles can lead to degeneration of nerves in atrophied regions, so that hemiplegic patients cannot regain equilibrium, and thus, walk unnaturally.

In such disabled patients, there is a close correlation between the period of rehabilitation training and reducing the term required for patients to be able to return to societal life in full capacity.

While the rehabilitation training period of disabled patients is begun when patients are capable of some degree of self-ambulation, the duration from the onset of disabilities to the point that patients are capable of self-ambulation is generally several months to several years. During this period, a patient is continuously confined to a bed, so that nerves in palsied regions naturally degenerate. Such naturally degenerated nerves are difficult to recover with rehabilitation training, leading to the patient being unable to return to society and lead a normal life.

SUMMARY OF THE INVENTION

An object of the present invention is to provide an early rehabilitation training system for enhancing rehabilitation training, that can be applied to early rehabilitation training of disabled patients who are unable to self-ambulate, while the patients lie in a treatment bed, to prevent natural degeneration of atrophied nerves and stimulate peripheral nerves in order to expedite recovery to a state in which patients may begin a second stage of rehabilitation training.

According to an object of the present invention, there is provided an early rehabilitation training system including: a treatment bed configured with a mattress, a base disposed below the mattress and coupled through a hinge to one end of the mattress, and a tilting unit provided between the mattress and the base to adjust an upright angle of the mattress; and a rotating unit provided below the mattress of the treatment bed to secure a patient's feet and provide artificial exercising of the patient's feet through gravity when the upright angle of the mattress is changed by the tilting unit.

According to the present invention, the rotating unit includes: a housing; a first pedal assembly and a second pedal assembly provided at either side of the housing and including a first pedal and a second pedal on which the patient's feet are positioned, and a first link and a second link coupled at a respective end thereof through hinges to the first and second pedals, respectively, in mutual opposition; and a connecting shaft passed through a center of the housing to connect the first and second links of the first and second pedal assemblies.

According to the present invention, the first and second pedals include a first load sensor and a second load sensor, respectively, the first and second load sensors detecting a shift in balance when the patient's feet change position according to a change in the upright angle of the mattress. The housing further includes a sensing amplifier to amplify load values measured by the first and second load sensors.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
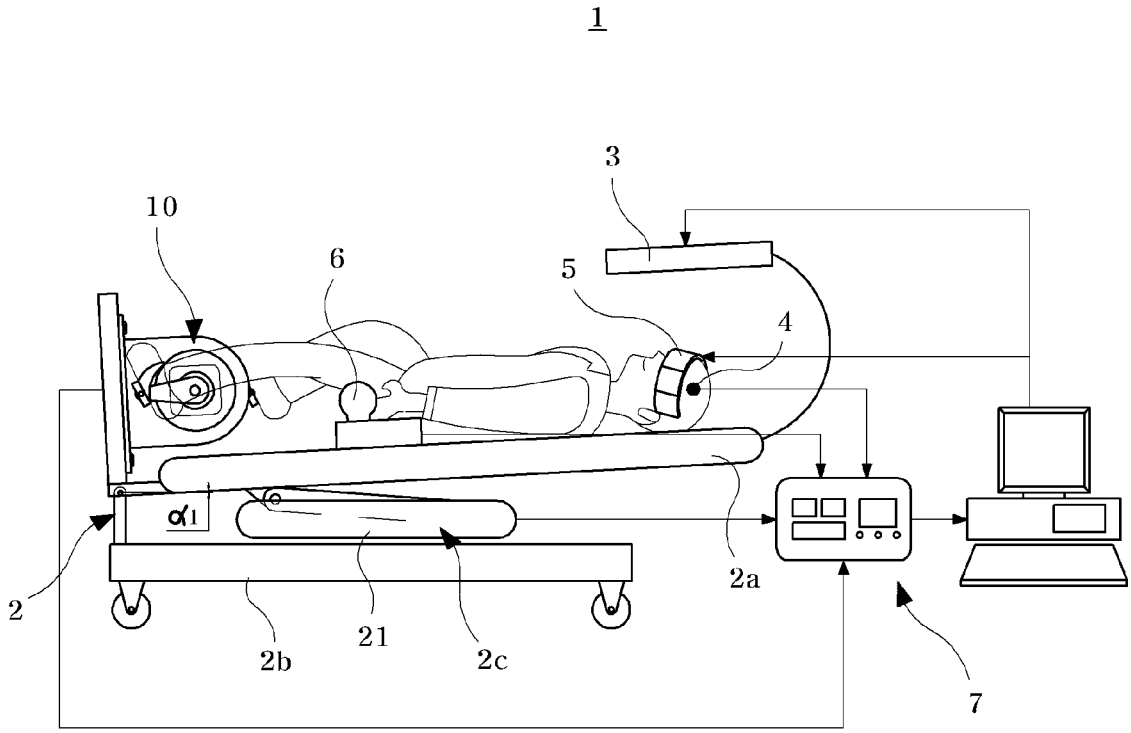
FIGS. 1 through 3 are schematic views showing rehabilitation training for legs with a bed for early rehabilitation training positioned at different angles, according to the present invention.
Figure 2:
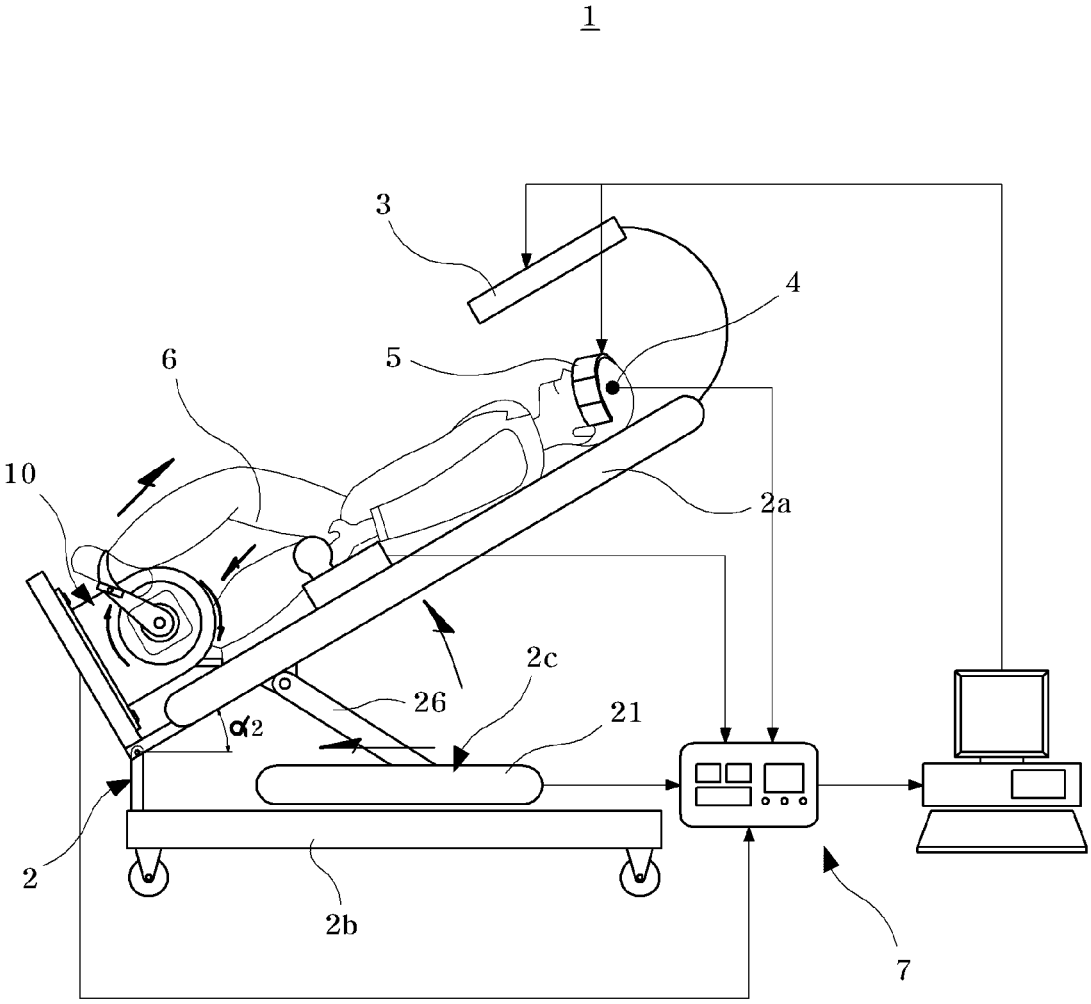
Figure 3:
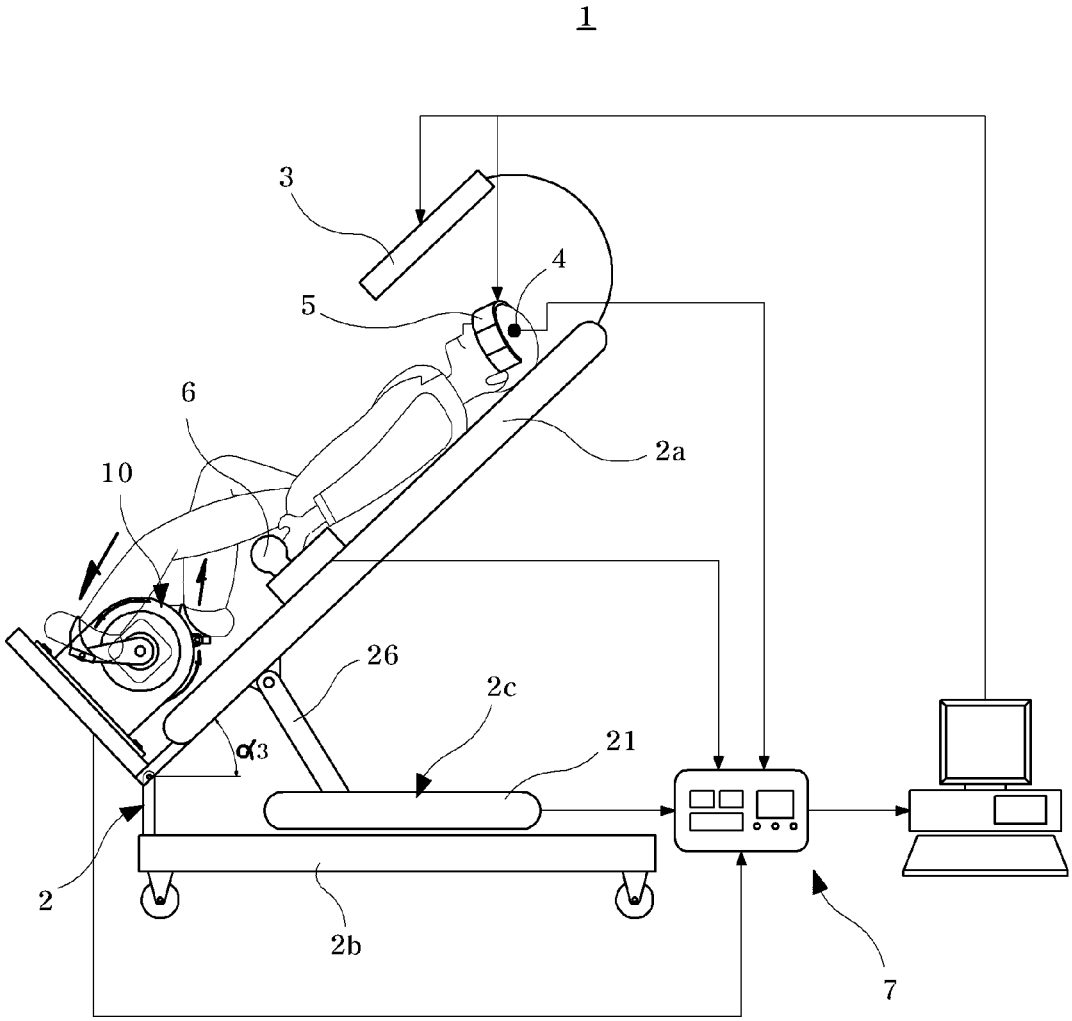

FIGS. 1 through 3 are schematic views showing rehabilitation training for legs with a bed for early rehabilitation training positioned at different angles, according to the present invention. Referring to FIGS. 1 through 3, an early rehabilitation training system 1 includes a treatment bed 2, a monitor 3 provided to a side of the treatment bed 2 at a position viewable by the patient, a sensor 4 attached to the patient's head to sense angles when the patient's head moves, a head-mounted display 5 worn around the patient's eyes to provide virtual reality through a program, a grip 6 disposed at a side of the treatment bed 2 for the patient to grasp, a rotating unit 10 configured at the lower end of the treatment bed 2 and having pedals to which the patient's feet are fixed, and a controller 7 for controlling the respective components and generating a virtual reality from a program.

The treatment bed 2 includes a mattress 2*a*, a base 2*b* disposed at the bottom of the mattress 2*a*, and a tilting unit 2*c* between the mattress 2*a* and the base 2*b* to adjust the upright angle of the mattress 2*a*.

The treatment bed 2, instead of being a separate unit, may be the same bed usually used by a patient, in order to allow a patient lying on the bed to frequently engage in early rehabilitation training.

The mattress 2*a* and the base 2*b* are configured to pivot with respect to one another through a hinge connecting respective ends thereof.

To enable free movement of the bed, a plurality of casters is formed at the bottom of the base 2*b*.

Figure 4:
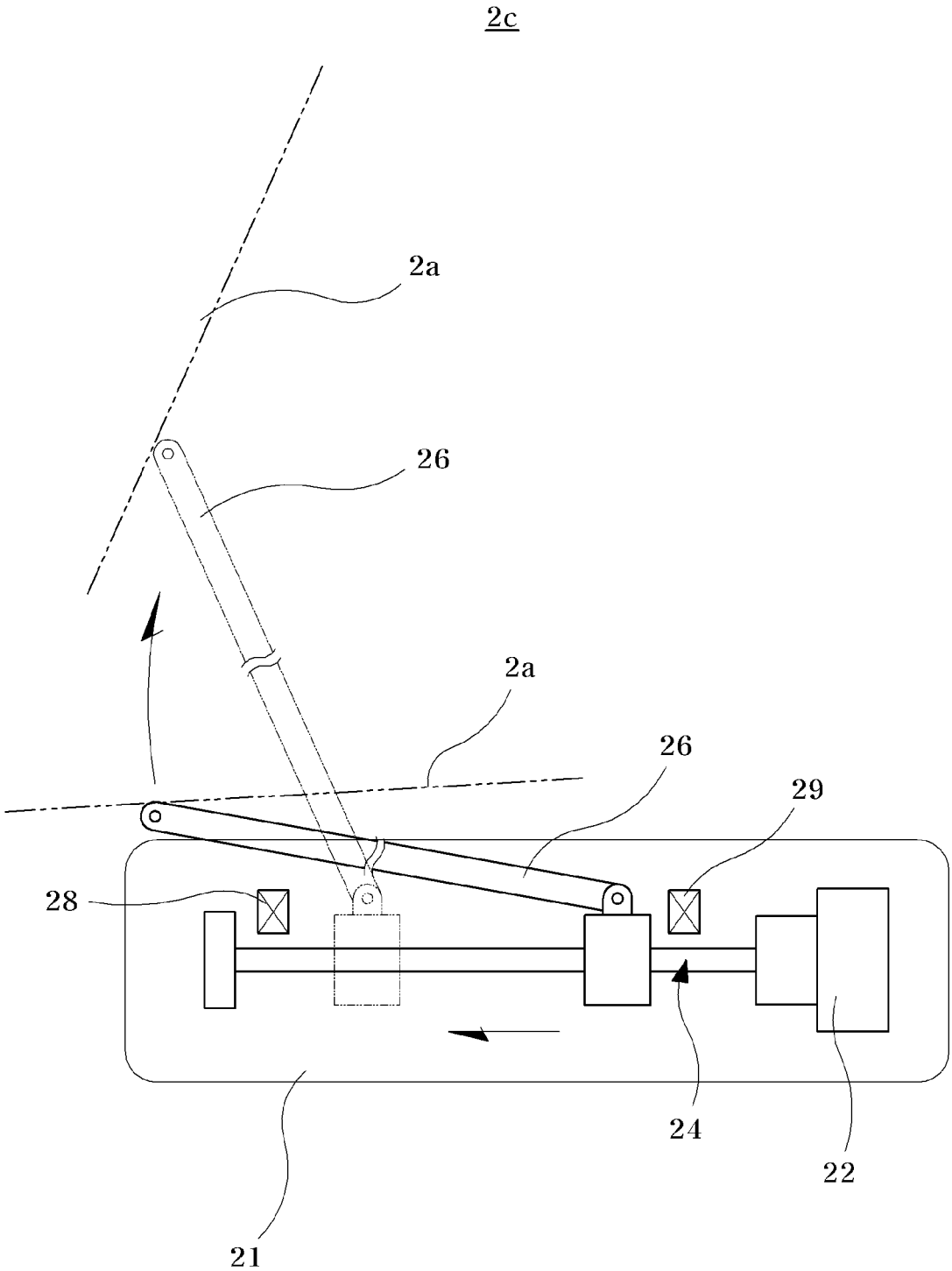
FIG. 4 is a partial sectional view showing a tilting unit in an operating state, according to the present invention.

Referring to FIG. 4, the tilting unit 2*c* includes a casing 21, a driving unit 22 provided at one end within the casing 21, a conveyor 24 provided at an end of the driving unit 22 to impart conveying force laterally, a link 26 fixed at one end to the conveyor 24 through a hinge and having the other end fixed to an end at the bottom of the mattress 2*a* through another hinge, and a maximum height sensor 28 and a minimum height sensor 29 at either end of the conveyor 24.

The driving unit 22 and the conveyor 24 may be configured as one of a motor and a spiral shaft rotated by the rotational force of the motor and a linear motor (LM) and an LM guide, but are not limited thereto, and may be any configuration capable of performing lateral reciprocation of the link 26.

The maximum and minimum height sensors 28 and 29 prevent the link 26 from unrestricted lateral movement along the conveyor 24, and the maximum and minimum upright angles of the mattress 2*a* are restricted by the variable position of the link 26.

The maximum and minimum height sensors 28 and 29 may employ limit switches; however, they are not limited thereto, and may employ any device that can easily detect the link 26.

The monitor 3 is provided at a position at which a patient lying on the mattress 2*a* may easily view it, and may be configured to be adjustable in position to suit different patient physiques.

The sensor 4 for sensing the angle of a patient's head is mounted on a patient's head to calculate the angle by which the patient's head moves, and generate a signal determining the moved direction of the patient's head within a virtual space, by means of a program.

The head-mounted display 5 is worn around the patient's eyes, to aid in rehabilitation training of the patient through providing various data or a virtual reality to the patient through a program.

The grip 6 projects from one of either side of the mattress 2*a*, and may further include a silicon, synthetic resin, or rubber cover covering the outer surface thereof to strengthen a patient's grasping force.

Furthermore, the grip 6 may be configured to be adjustable according to a patient's height and capable of sliding up and down.

In addition, an emergency switch (not shown) may be provided at an end of the grip 6, enabling a patient to alert a caregiver of a personal emergency or temporarily stop the rehabilitation training apparatus.

In cases dictated by a patient's condition—that is, in cases where a patient is unable to move his/her head, instead of the sensor 4 for detecting head movement angle, a sensor may be provided at the patient's fingers or wrist to sense movement of the fingers or wrist.

Figure 5:
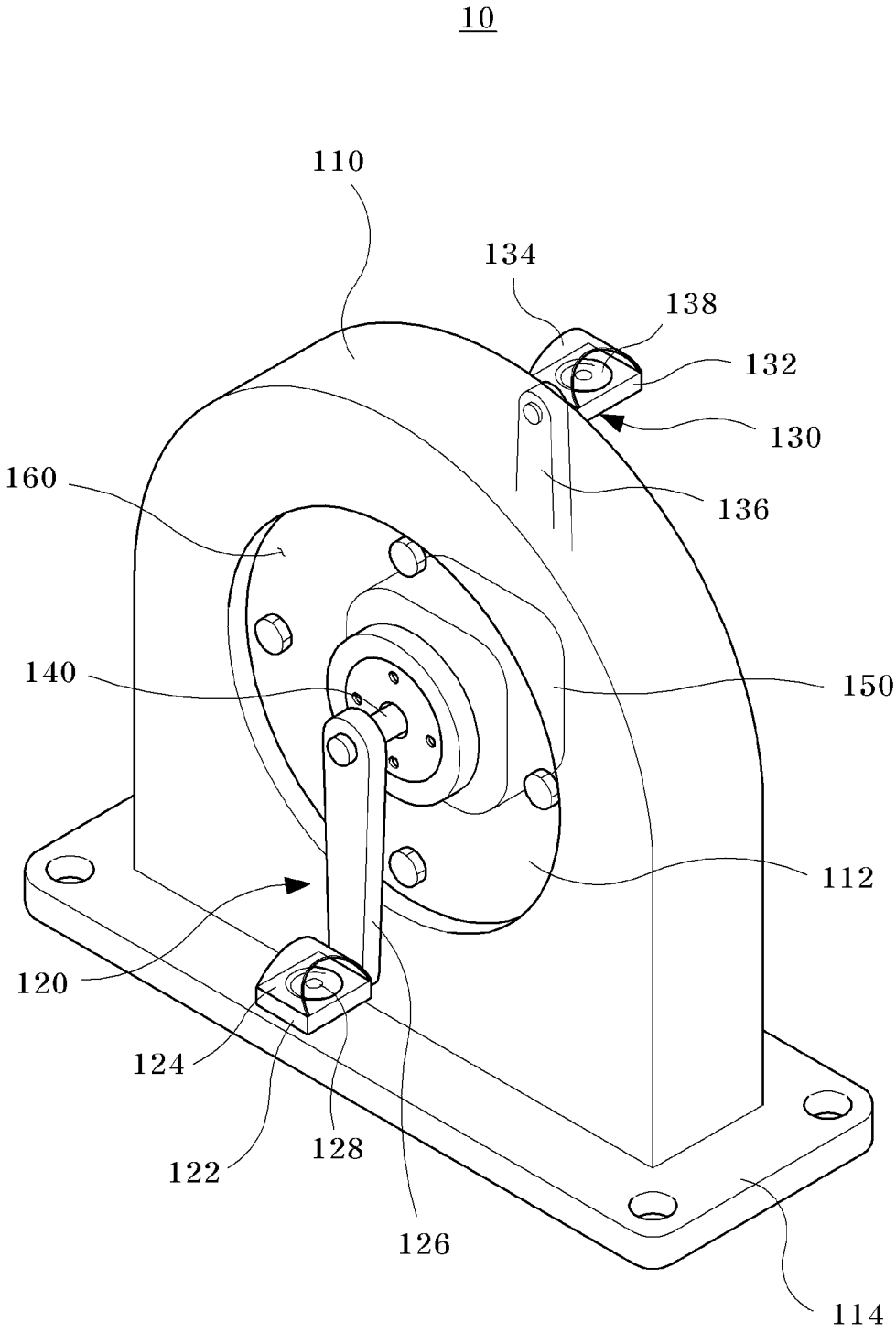
FIG. 5 is a perspective view of a rotating unit according to the present invention.
Figure 6:
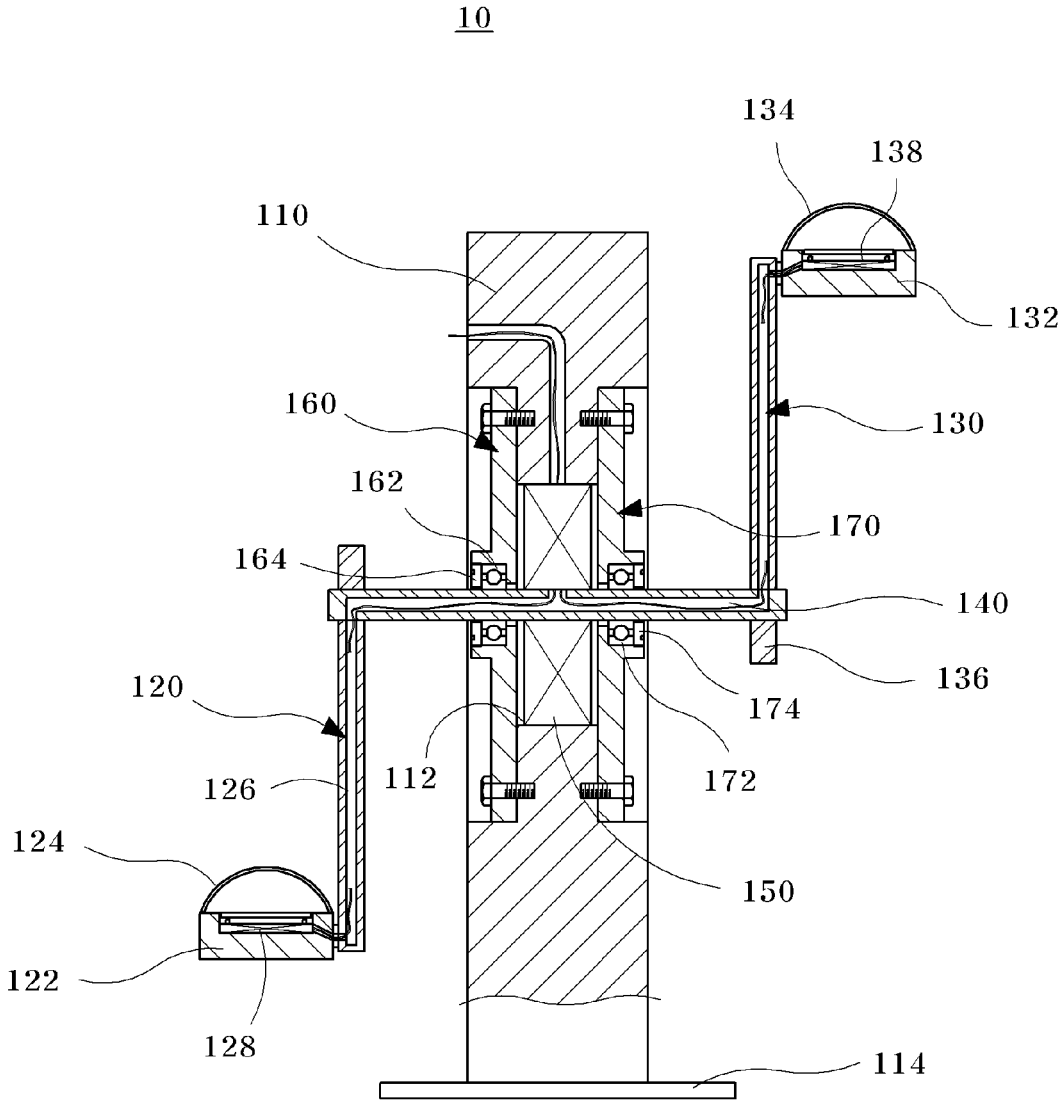
FIG. 6 is a sectional view of the rotating unit in FIG. 5.

Referring to FIGS. 5 and 6, the rotating unit 10 includes a housing 110, a first and second pedal assembly 120 and 130, and a connecting shaft 140 passed through the center of the housing 110 to connect the first and second pedal assemblies 120 and 130.

The first and second pedal assemblies 120 and 130 have a first and second load sensor 128 and 138, respectively, to detect changes in rotational load—that is, to detect movement about the center, and further includes a sensing amplifier 150 within or to a side of the housing 110 to amplify values detected by the first and second load sensors 128 and 138.

Moreover, a first and second cover 160 and 170 may be further provided at the respective sides of the housing 110 to securely fix the sensing amplifier 150 and to secure the connecting shaft 140 and reliable rotation thereof.

The housing 110 has an insert hole 112 defined in a center thereof to accommodate the sensing amplifier 150 therein, and a mounting plate 114 formed at the bottom thereof to fix the housing 110 to the treatment bed 2 via fastening members.

The first and second pedal assemblies 120 and 130, like bicycle pedals, are mutually opposed to fix the feet of lower limbs on either side.

The first and second pedal assemblies 120 and 130 include a first and second pedal 122 and 132, respectively, on which both feet are placed, first and second securing member 124 and 134 formed at one side of the first and second pedals 122 and 132, respectively, to prevent arbitrary disengagement of feet from the pedals, and first and second links 126 and 136 provided at an end of the first and second pedals 122 and 132, respectively.

The first and second pedals 122 and 132 are coupled at one end thereof to an end of the first and second links 126 and 136 through hinges, respectively, so that the first and second pedals 122 and 132 may rotate about the hinges.

The other end of the first and second links 126 and 136 are fixed and coupled to the connecting shaft 140 passed through the center of the housing 110.

The first and second securing members 124 and 134 are members that can easily secure feet atop the first and second pedals 122 and 132, and may be formed of one of heavy duty straps, velcro tape, or rubber bands.

As shown, the first and second pedals 122 and 132 include first and second load sensors 128 and 138 to measure the rotational load transferred to the first and second pedals 122 and 132 from the feet placed on the first and second pedals 122 and 132 and from gravity according to the upright angle of the mattress 2*a*.

The first and second load sensors 128 and 138 may be load cells; however, they are not limited thereto, and may alternately be any device capable of measuring loads transferred to the first and second pedals 122 and 132.

The load cells employed as the first and second load sensors 128 and 138 may be configured as strain gauge or piezoelectric-type load cells.

The first and second load sensors 128 and 138 are connected to the controller 7 to transfer measured load values and decipher a patient's transfer of balance from changes in the transferred load values.

Because differences between load values measured by the first and second load sensors 128 and 138 are subtle, the measured load values may be amplified by the sensing amplifier 150 provided in the housing 110, and the amplified measured load values may be transferred to the controller 7.

The first and second covers 160 and 170 are respectively coupled and fixed at either side of the housing 110 by means of fastening members, and include a first and second bearing 162 and 172, respectively, through which the connecting shaft 140 is inserted, and first and second bearing mounts 164 and 174 to fix the positions of the first and second bearings 162 and 172, respectively.

Of course, the first and second bearings 162 and 172 and the first and second bearing mounts 164 and 174 may be substituted with a bushing or any other members that can support the smooth rotation of the connecting shaft 140.

Referring to FIG. 6, a cable is shown connecting the first and second load sensors 128 and 138 mounted on the first and second pedals 122 and 132 to the sensing amplifier 150, and extending outward from a side of the sensing amplifier 150 to connect the latter to the controller. The connections of the cable may employ various methods and types of cables that are widely known in the art.

The controller 7 may be referred to as an overall controlling unit of the early rehabilitation training system 1, and controls the above-described devices. For example, the controller 7 adjusts the upright position of the mattress 2*a* of the treatment bed 2, displays various data and the current status on the monitor 3, calculates the angle of head movement derived through the head rotation angle sensor 4, displays a program-generated virtual reality or various data through the head-mounted display 5, calculates the transfer of rotational balance according to changes in load values of the rotating unit 10, and combines and transfers various data, to aid in early rehabilitation training of a patient or outputs various data according to requirements.

Operating states of the above-configured early rehabilitation training system will be described below.

Referring to FIG. 1, a state for a patient in the primary stage of rehabilitation training—that is, a state maintaining the patient in a comfortable prone position—is depicted. Here, presuming that the mattress 2*a*, as shown, is substantially horizontal (hereinafter referred to as "horizontal"), with the mattress 2*a* in an initial upright angle (a1=0°), the rotating unit 10 is installed at the bottom end of the mattress 2*a*.

Then, with the patient's feet set atop the first and second pedals 122 and 132 of the first and second pedal assemblies 120 and 130, respectively, the first and second securing members 124 and 134 secure the respective feet.

Here, the first and second pedal assemblies 120 and 130 are configured in mutual opposition to support the lower limbs according to the height and positional displacement thereof, the first and second load sensors 128 and 138 included in the first and second pedals 122 and 132 of the first and second pedal assemblies 120 and 130 measure loads from the feet, and the measured load values amplified by the sensing amplifier 150 are transferred to the controller 7.

Through this process, the balanced position of a patient can be determined.

Of course, the monitor 3, sensor 4 for head rotation angle sensing, head-mounted display 5, and grip 6 may selectively be installed on the treatment bed 2 or the positions thereof may be altered according to the condition of the patient, in order to complete initial setup of the early rehabilitation training system 1.

Referring to FIG. 2, the mattress 2*a* of the treatment bed 2 is raised by a first angle (a2), and artificial exercising of the lower limbs can be undertaken with the positions of the feet placed on the first and second pedal assemblies 120 and 130 of the rotating unit 10 being altered by gravity.

In further detail, with respect to changing the upright angle of the mattress 2*a* through the tilting unit 2*c* as shown in FIG. 4, when the driving unit 22 of the tilting unit 2*c* generates rotating force in one direction, the conveyor 24 provided at an end of the driving unit 22 is conveyed in a direction according to the direction of rotation, and thus, the link 26 coupled at one end to the conveyor 24 is moved in one direction. Here, the direction of movement, as shown, is from left to right.

Here, when one end of the link 26 is moved in one direction, the other end (being coupled to the mattress 2*a* through a hinge) raises the mattress 2*a* by the first upright angle (a2).

While the mattress is being raised to the first upright angle (a2) by the tilting member 2*c*, one of the feet secured to the first and second pedals 122 and 132 is lowered by gravity lowering one of the first and second pedals 122 and 132 and raising the other, so that artificial exercising of the patient's lower limbs can be performed.

Referring to FIG. 3, when the operation of the tilting unit 2*c* raises the mattress 2*a* to a second upright angle (a3), the patient's feet secured to the first and second pedals 122 and 132, from positions where one of the first and second pedals 122 and 132 positioned higher and the other positioned lower at the first upright angle (a2), the pedal disposed higher is pressed down by the force of the foot thereon, so that the pedal in the lower position rises, to continuously perform exercising of the patient's lower limbs.

That is, the first and second pedal assemblies 120 and 130 of the rotating unit 10 are reciprocally rotated through being connected to one another by the connecting shaft 140, thereby performing rehabilitation training exercising the patient's lower limbs.

Furthermore, the first and second load sensors 128 and 138 are configured on the first and second pedals 122 and 132, so that when the first and second pedals 122 and 132 are rotated by a predetermined angle, the load sensors 128 and 138 determine the changes in load values on the first and second pedals 122 and 132 to discern whether the rotation has been induced by the patient's shift in center of gravity and the patient's own volition or simply from artificial rotation. In this way, the patient's level of rehabilitation training can be discerned.

Also, the maximum and minimum height sensors 28 and 29 are provided on the conveying unit 24 of the tilting unit 2*c*, to restrict the distance in which the link 26 moves along the conveying unit 24 and prevent the mattress 2*a* from being positioned in excessively upright or prone positions.

The rotating unit 10 may operate in connection with the plurality of other components configured on the treatment bed 2. With regard to the connection between the head-mounted display 5 and the rotating member 10, with the head-mounted display 5 worn around the patient's eyes, the patient is provided with a virtual reality provided by a virtual reality program through the controller 7.

Supposing that the virtual reality is a car race, when the patient simply moves his/her head to the left or right in order to avoid a collision between the patient's own car and another car or to change course, the head-mounted sensor 4 mounted to the patient's head detects the head movement and relays the corresponding signal to the controller 7, so that the relayed head movement data can redirect the patient's car in the virtual reality environment.

Also, the rotating speed of the first and second pedal assemblies 120 and 130 of the rotating unit 10 may be calculated according to the upright angle of the mattress 2*a*, and the calculated rotating speed may be applied to the patient's own car to adjust the car's speed, thereby generating more interest for the patient so that the patient continues with rehabilitation training.

Of course, because early rehabilitation training may be performed from the initial stages of recovery, it can shorten the time required to begin a secondary stage of rehabilitation training, leading to faster rehabilitation and return of a patient to society.

The above early rehabilitation training system of the present invention has the effect of enhancing rehabilitation training by allowing patients unable to self-ambulate at the initial stages of debilitating symptoms or palsied patients to continuously receive rehabilitation training while lying in treatment beds, to prevent natural degeneration of atrophied nerves and stimulate peripheral nerves in order to expedite recovery to a state in which the patients may begin a second stage of rehabilitation training.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An early rehabilitation training system comprising:

a treatment bed including a mattress, a base disposed below the mattress and coupled through a hinge to one end of the mattress, and a tilting unit provided between the mattress and the base, the tilting unit adjusting an upright angle of the mattress; and a rotating unit joined to the treatment bed and securing a patient's feet and providing artificial exercising of the patient's feet through gravity when the upright angle of the mattress is changed by the tilting unit, wherein the mattress has a substantially flat shape that is maintained during the adjusting of the upright angle by the tilting unit without being bent to make an angled portion therein, wherein the rotating unit rotates about a point about which the mattress turns to change the upright angle as the upright angle of the mattress changes, wherein the tilting unit includes:

a casing;

a driving unit provided at one end within the casing;

a conveyor provided at an end of the driving unit to impart conveying force laterally;

a link including one end fixed to the conveyor through a hinge and the other end fixed to a bottom of the mattress through another hinge;

a maximum height sensor at one end of the conveyor and a minimum height sensor provided at the other end of the conveyor, wherein the rotating unit includes:

a housing;

a first pedal assembly provided at one side of the housing and a second pedal assembly provided at the other side of the housing, each pedal assembly including a pedal on which the patient's feet are placed, a link coupled to the pedal through an hinge, and a load sensor measuring load values transferred to the pedal and detecting a shift in balance when the patient's feet change position according to a change in the upright angle of the mattress; and a connecting shaft passing through a center of the housing to connect the link of the first pedal assembly and the link of the second pedal assembly.

2. The early rehabilitation training system of claim 1, wherein the housing further comprises a sensing amplifier to amplify the load values measured by the load sensors of the first and second pedal assemblies.

* * * * *